US012037857B2

(12) United States Patent
Al-Malki et al.

(10) Patent No.: US 12,037,857 B2
(45) Date of Patent: Jul. 16, 2024

(54) METHOD AND SYSTEM FOR DETERMINING HOLE CLEANING EFFICIENCY BASED ON WELLBORE SEGMENT LENGTHS

(71) Applicant: SAUDI ARABIAN OIL COMPANY, Dhahran (SA)

(72) Inventors: Mohammed Ali Al-Malki, Dhahran (SA); Mahmoud F. Abughaban, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 394 days.

(21) Appl. No.: 17/538,568

(22) Filed: Nov. 30, 2021

(65) Prior Publication Data

US 2023/0167695 A1 Jun. 1, 2023

(51) Int. Cl.
*E21B 21/08* (2006.01)
*E21B 21/06* (2006.01)
(Continued)

(52) U.S. Cl.
CPC ..... *E21B 21/08* (2013.01); *E21B 21/06* (2013.01); *E21B 44/00* (2013.01); *E21B 45/00* (2013.01);
(Continued)

(58) Field of Classification Search
CPC ..... E21B 21/08; E21B 21/06; E21B 44/00; E21B 45/00; E21B 49/003; E21B 2200/20; E21B 44/02; E21B 37/00
See application file for complete search history.

(56) References Cited

U.S. PATENT DOCUMENTS 5,063,776 A 11/1991 Zanker et al.
6,115,671 A 9/2000 Fordham et al.
(Continued)

FOREIGN PATENT DOCUMENTS

CN 102839934 A 12/2012
CN 101899969 B 4/2013
(Continued)

OTHER PUBLICATIONS

Ofei, Titus Ntow, "Effect of Yield Power Law Fluid Rheological Properties on Cuttings Transport in Eccentric Horizontal Narrow Annulus", Journal of Fluids, Hindawi Publishing Corporation, vol. 2016, Article ID 4931426, 2016, pp. 1-10 (10 pages).
(Continued)

*Primary Examiner* — Ziaul Karim
(74) *Attorney, Agent, or Firm* — Osha Bergman Watanabe & Burton LLP

(57) ABSTRACT

A method may include obtaining, in real-time with a drilling operation, density data regarding a drilling fluid circulating in a wellbore. The method may further include determining mud velocity data of the drilling fluid in the wellbore based on flow rate data and a borehole area of the wellbore. The method may further include determining a cuttings weight of the drilling fluid in the wellbore based on the density data. The cuttings weight and the mud velocity data may correspond to a respective segment length among various segment lengths of the wellbore. The method may further include determining, based on the cuttings weight, the mud velocity data, and a hole cleaning model, various hole cleaning efficiency (HCE) values for the segment lengths of the wellbore. The method may further include determining whether an HCE value among the HCE values fails to satisfy a predetermined criterion.

18 Claims, 8 Drawing Sheets

(51) Int. Cl.
*E21B 44/00* (2006.01)
*E21B 45/00* (2006.01)
*E21B 49/00* (2006.01)

(52) U.S. Cl.
CPC ..... *E21B 49/003* (2013.01); *E21B 2200/20* (2020.05)

(56) References Cited

U.S. PATENT DOCUMENTS

| | | | | |
|---|---|---|---|---|
| 6,357,536 | B1 | 3/2002 | Schrader et al. | |
| 9,995,129 | B2 * | 6/2018 | Dykstra | G06F 17/11 |
| 10,062,044 | B2 * | 8/2018 | Hildebrand | E21B 7/04 |
| 10,449,477 | B2 | 10/2019 | Johnson et al. | |
| 10,487,603 | B2 | 11/2019 | Manwill et al. | |
| 10,494,913 | B2 * | 12/2019 | Ling | G06F 30/20 |
| 2002/0010548 | A1 | 1/2002 | Tare et al. | |
| 2003/0052673 | A1 | 3/2003 | Speier et al. | |
| 2009/0188718 | A1 | 7/2009 | Kaageson-Loe et al. | |
| 2009/0250264 | A1 | 10/2009 | Dupriest | |
| 2010/0026293 | A1 | 2/2010 | Minh | |
| 2011/0174541 | A1 | 7/2011 | Strachan et al. | |
| 2013/0080066 | A1 | 3/2013 | Al-Dossary et al. | |
| 2013/0299241 | A1 | 11/2013 | Alberty et al. | |
| 2014/0326449 | A1 | 11/2014 | Samuel et al. | |
| 2015/0211350 | A1 * | 7/2015 | Norman | G05B 15/02 702/9 |
| 2015/0292323 | A1 | 10/2015 | Shahri et al. | |
| 2015/0300151 | A1 * | 10/2015 | Mohaghegh | E21B 47/07 702/9 |
| 2016/0053604 | A1 | 2/2016 | Abbassian et al. | |
| 2016/0080066 | A1 | 3/2016 | Alamouti et al. | |
| 2016/0231450 | A1 | 8/2016 | Shao et al. | |
| 2016/0370492 | A1 | 12/2016 | Chen et al. | |
| 2017/0044896 | A1 | 2/2017 | Salminen | |
| 2017/0075004 | A1 | 3/2017 | Mccolpin et al. | |
| 2017/0176228 | A1 | 6/2017 | Elisabeth | |
| 2017/0191919 | A1 | 7/2017 | Kulkarni et al. | |
| 2018/0003045 | A1 | 1/2018 | Dotson et al. | |
| 2018/0012384 | A1 * | 1/2018 | Marland | E21B 47/12 |
| 2018/0037797 | A1 | 2/2018 | Brady et al. | |
| 2018/0106147 | A1 | 4/2018 | Lakings et al. | |
| 2018/0127632 | A1 | 5/2018 | Amanullah | |
| 2018/0266197 | A1 | 9/2018 | Amanullah et al. | |
| 2018/0335530 | A1 | 11/2018 | Wu et al. | |
| 2019/0055797 | A1 * | 2/2019 | Astrid | E21B 21/08 |
| 2019/0094119 | A1 | 3/2019 | Singh et al. | |
| 2019/0178770 | A1 | 6/2019 | Marum et al. | |
| 2019/0309614 | A1 * | 10/2019 | Benson | E21B 21/08 |
| 2019/0316457 | A1 * | 10/2019 | Al-Rubaii | E21B 44/06 |
| 2020/0270958 | A1 * | 8/2020 | Omrani | E21B 37/00 |
| 2020/0355839 | A1 | 11/2020 | Jeong et al. | |
| 2020/0362694 | A1 | 11/2020 | Al-Rubaii et al. | |
| 2020/0362695 | A1 | 11/2020 | Al-Rubaii et al. | |
| 2020/0370381 | A1 | 11/2020 | Al-Rubaii et al. | |
| 2020/0370426 | A1 | 11/2020 | Dugas | |
| 2020/0371495 | A1 * | 11/2020 | Al-Rubaii | G05B 9/00 |

FOREIGN PATENT DOCUMENTS

| | | | |
|---|---|---|---|
| WO | 2010054476 | A1 | 5/2010 |
| WO | 2015/072962 | A1 | 5/2015 |
| WO | 2015191091 | A1 | 12/2015 |
| WO | 2018/208634 | A1 | 11/2018 |
| WO | 2020139415 | A1 | 7/2020 |
| WO | 2020142073 | A1 | 7/2020 |

OTHER PUBLICATIONS

Robinson, Leon and Mark Morgan, "Effect of Hole Cleaning on Drilling Rate and Performance", AADE-04-DF-HO-42, American Association of Drilling Engineers, Apr. 2004, pp. 1-7 (7 pages).

Williams, Jr., C.E. and G.H. Bruce, "Carrying Capacity of Drilling Muds", T.P. 3026, Petroleum Transactions, AIME, vol. 192, 1951, pp. 111-120 (10 pages).

Pigott, R.J.S., "Mud Flow in Drilling", Drilling and Production Practice, American Petroleum Institute, 1941, pp. 91-103 (13 pages).

Raheem, Oriyomi Nurudeen et al., "Using NMR T2 to Predict the Drainage Capillary Curves Pc-Sw in Carbonates Reservoirs", SPE-185989-MS, Society of Petroleum Engineers, May 2017, pp. 1-34 (34 pages).

Ams, C.H. et al., "Prediction of permeability from NMR response: surface relaxivity heterogeneity", SPWLA 47th Annual Logging Symposium, Society of Petrophysicists and Well Log Analysts, Jun. 2006, pp. 1-13 (13 pages).

Nicot, Benjamin et al., "Improvement of Viscosity Prediction Using NMR Relaxation", SPWLA 48th Annual Logging Symposium, Society of Petrophysicists and Well Log Analysts, Jun. 2007, pp. 1-7 (7 pages).

Di, Jianwei and Jerry L. Jensen, "A New Approach for Permeability Prediction With NMR Measurements in Tight Formations", Aug. 2016 SPE Reservoir Evaluation & Engineering, Society of Petroleum Engineers, 2016, pp. 481-493 (13 pages).

Dziuba, Taras T., "Improved Permeability Prediction in Carbonates", SPWLA 37th Annual Logging System Symposium, Jun. 1996, pp. 1-12 (12 pages).

Lonnes, Steve et al., "NMR Petrophysical Predictions on Cores", SPWLA 44th Annual Logging Symposium, Jun. 2003, pp. 1-14 (14 pages).

Keating, Kristina et al., "Improving pore-size distribution and permeability prediction from NMR using DT2 maps", SEG International Exposition and 89th Annual Meeting, SEG, 2019, pp. 4809-4813 (5 pages).

Wampler, J.J et al., "Estimating permeability in UAE carbonates using NMR", SEG Denver 2010 Annual Meeting, SEG, 2010, pp. 2649-2653 (5 pages).

Zayed, Samy et al., "Permeability Prediction Using NMR Measurements for Some Gas Reservoirs—Nile Delta, Egypt", 14th Offshore Mediterranean Conference and Exhibition, Mar. 2019, pp. 1-11 (11 pages).

Musu, Junita Trivianty and Bambang Widarsono, "Determination of NMR T2 cut off for ductile, low permeability shaly sandstone", ASEG Extended Abstracts, Taylor & Francis, 2007:1, pp. 1-10 (11 pages).

Besghini, Denise et al., "Time Domain NMR in Polymer Science: From the Laboratory to the Industry", Applied Sciences, MDPI, vol. 9, No. 1801, Apr. 2019, pp. 1-33 (33 pages).

Salimifard, Babak et al., "Optimizing NMR Data Acquisition and Data Processing Parameters for Tight-Gas Montney Formation of Western Canada", SCA2017-020, International Syposium of the Society of Core Analysts, Aug.-Sep. 2017, pp. 1-13 (13 pages).

Mohammadsalehi. M. and Malekzadah, N.; "Application of New Hole Cleaning Optimization Method within All Ranges of Hole Inclinations", IPTC 14154; International Petroleum Technology Conference; Feb. 2012; pp. 1-8 (8 pages).

Samsuri, A. and Hamzah, A.; "Water based mud lifting capacity improvement by multiwall carbon nanotubes additive", Journal of Petroleum and Gas Engineering; vol. 2; No. 5; Apr. 12, 2011; pp. 99-107 (9 pages).

H. N. Hall et al.; "Ability Of Drilling Mud To Lift Bit Cuttings", Petroleum Transactions, AIME; vol. 189; 1950; pp. 35-46 (12 pages).

Pandya et al.; "Effects of Particle Density on Hole Cleanout Operation in Horizontal and Inclined Wellbores", SPE-194240-MS; Society of Petroleum Engineers; Mar. 2019; pp. 1-22 (22 pages).

Walker, R.E. and Mayes, T. M.; "Design of Muds for Carrying Capacity", SPE-4975-PA; Journal of Petroleum Technology; vol. 27; No. 7; Jul. 1975; pp. 893-900 (8 pages).

R. H. McLean; "Velocities, Kinetic Energy and Shear in Crossflow Under Three-Cone Jet Bits", SPE 1306; Society of Petroleum Engineers; Dec. 1965; pp. 1443-1448 (6 pages).

Gooneratne et al., "Downhole Applications of Magnetic Sensors," MDPI, Sensors, Oct. 19, 2017, 32 pages.

Final Office Action issued in related U.S. Appl. No. 17/174,625 dated Feb. 26, 2024 (47 pages).

(56) References Cited

OTHER PUBLICATIONS

International Search Report and Written Opinion issued in corresponding International Patent Application No. PCT/US2022/015320, mailed on May 11, 2022 (12 pages).
International Search Report and Written Opinion issued in corresponding International Patent Application No. PCT/US2022/016160, mailed on May 11, 2022 (18 pages).
Office Action issued in corresponding U.S. Appl. No. 17/174,625, issued Oct. 24, 2022 (43 pages).
"Permeability estimation with NMR logging", PetroWiki, Glenda Smith; Mar. 27, 2013, https://petrowiki.spe.org/Permeability_estimation_with_NMR_logging; https://petrowiki .spe.org/File:Vol5_Page_0323_Image_0001.png (Year: 2013) (5 pages).
Non-Final Office Action issued in related U.S. Appl. No. 17/174,625 dated Oct. 2, 2023 (43 pages).
Alawami, M. et al., "SPE-196448-MS: A Real-Time Indicator for the Evaluation of Hole Cleaning—Ã Efficiency," SPE International, Society of Petroleum Engineers, pp. 1-9, Oct. 25, 2020 (9 pages).
Al-Rubaii, M.M. et al., "IPTC-19809-MS: Automated Evaluation of Hole Cleaning Efficiency While Drilling Improves Rate of Penetration," IPTC, pp. 1-17, Jan. 13, 2020 (17 pages).
Office Action issued in corresponding Saudi Arabian Application No. 122440690; dated May 6, 2024 (6 pages).
Office Action issued in corresponding Saudi Arabian Application No. 523450263; dated May 19, 2024 (14 pages).

* cited by examiner

Hydraulic Friction as a Function of Flow Rate q
(Theoretical Pump Perfomance)

METHOD AND SYSTEM FOR DETERMINING HOLE CLEANING EFFICIENCY BASED ON WELLBORE SEGMENT LENGTHS

BACKGROUND

Drilling fluid, also called drilling mud or simply mud, may be a heavy, viscous fluid mixture that is used in oil and gas drilling operations to carry rock cuttings from a wellbore back to the surface. Drilling mud may also be used to lubricate and cool a drill bit. The drilling fluid, by hydrostatic pressure, may also assist in preventing the collapse of unstable strata into the wellbore as well as the intrusion of water from stratigraphic formations proximate the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining, by a computer processor and in real-time with a drilling operation, density data regarding a drilling fluid circulating in a wellbore. The method further includes determining, by the computer processor, mud velocity data of the drilling fluid in the wellbore based on flow rate data and a borehole area of the wellbore. The method further includes determining, by the computer processor, a cuttings weight of the drilling fluid in the wellbore based on the density data. The cuttings weight and the mud velocity data correspond to a respective segment length among various segment lengths of the wellbore. The method further includes determining, by the computer processor and based on the cuttings weight, the mud velocity data, and a hole cleaning model, various hole cleaning efficiency (HCE) values for the segment lengths of the wellbore. The method further includes determining, by the computer processor, whether an HCE value among the HCE values fails to satisfy a predetermined criterion. The method further includes determining, by the computer processor and in response to the HCE value failing to satisfy the predetermined criterion, an adjusted rate of penetration (ROP) value for the drilling operation in the wellbore based on the HCE value. The method further includes transmitting, by the computer processor, a command to a drilling system that produces the adjusted ROP value in the drilling operation.

In general, in one aspect, embodiments relate to a system that includes a drilling system including a drill string and various sensors. The drilling system is coupled to a wellbore. The system further includes a mud pump system coupled to the wellbore, wherein the mud pump system supplies a drilling fluid to the wellbore. The system further includes a control system coupled to the drilling system and the mud pump system, where the control system includes a computer processor. The control system obtains, in real-time with a drilling operation, density data regarding the drilling fluid circulating in the wellbore. The control system determines mud velocity data of the drilling fluid in the wellbore based on flow rate data and a borehole area of the wellbore. The control system determining a cuttings weight of the drilling fluid in the wellbore based on the density data. The cuttings weight and the mud velocity data correspond to a respective segment length among various segment lengths of the wellbore. The control system determines, based on the cuttings weight, the mud velocity data, and a hole cleaning model, various hole cleaning efficiency (HCE) values for the segment lengths of the wellbore. The control system determines whether an HCE value among the HCE values fails to satisfy a predetermined criterion.

In general, in one aspect, embodiments relate to a user device that includes a display device, a processor coupled to the display device, and a memory coupled to the processor, where the memory includes instructions. The instructions present, using a graphical user interface in the display device, various hole cleaning efficiency (HCE) values for a drilling fluid in association with various segment lengths of a wellbore. The HCE values are based on a hole cleaning model, a cuttings weight of the drilling fluid, and mud velocity data. The cuttings weight of the drilling fluid in the wellbore is based on density data regarding an initial drilling fluid and a wellbore drilling fluid at a respective segment length among the segment lengths. The instructions obtain, in response to presenting the HCE values, a user selection of an adjusted ROP value. The instructions transmit, in response to the user selection, a command to a drilling system that produces the adjusted ROP value in a drilling operation.

In some embodiments, a predetermined type of lost circulation material (LCM) is determined based on the first HCE value, and a command is transmitted to a well system that adjusts the drilling operation to use the predetermined type of LCM. In some embodiments, a predetermined density value is determined based on the first HCE value, where the predetermined density value increases hole cleaning in the wellbore. A command is transmitted, based on the predetermined density value, to a mud pump system that adjusts a density of the drilling fluid prior to entering the wellbore. In some embodiments, various segment lengths divide the wellbore based on a rate of penetration (ROP) of a drill string of the drilling operation and various time steps. In some embodiments, flow rate data is obtained regarding an initial flow of the drilling fluid in the wellbore. An adjusted flow rate of the drilling fluid is determined based on the flow rate data and an HCE value that fails to satisfy a predetermined criterion, where the adjusted flow rate has a greater velocity than a flow rate of the initial flow. In some embodiments, the cuttings weight is based on a difference between a first mass value and a second mass value that are determined using a respective segment volume corresponding to the respective segment length of the first plurality of segment lengths, where the first mass value corresponds to an initial flow of the drilling fluid prior to entering the wellbore, and the second mass value corresponds to a flow of the drilling fluid in the wellbore at the respective segment length. In some embodiments, a dynamic pressure of the drilling fluid in the wellbore is determined based on a density value of the drilling fluid and a segment volume of the respective segment length of various segment lengths, where the dynamic pressure describes a difference between a total pressure of the drilling fluid and a static pressure of the drilling fluid, where the density value is obtained from a mud property sensor. In some embodiments, the drilling fluid is a compressible drilling fluid, and the dynamic pressure is based on a Mach number and a ratio of specific heat. In some embodiments, flow rate data are obtained regarding an initial flow of the drilling fluid in the wellbore. An adjusted flow rate of the drilling fluid is determined based on the flow rate data and an HCE value that fails to satisfy a predetermined criterion, where the adjusted flow rate is a greater velocity than a flow rate of the initial flow.

In some embodiments, various HCE values are presented by a graphical user interface in a user device and where the HCE values correspond to various segment lengths of the wellbore. A determination may be made whether an HCE value among the HCE values satisfies a predetermined threshold. A user selection of an ROP value may be obtained by a user device in response to at least one HCE value failing to satisfy the predetermined threshold. In some embodiments, the predetermined criterion is a clean hole threshold. In some embodiments, a mud lift capacity for the drilling fluid is determined based on the cuttings weight and a mud mass of the drilling fluid at the respective segment length. In some embodiments, a user device coupled to the control system, where the user device provides a graphical user interface for presenting various HCE values to a user and obtains one or more user selections regarding an adjusted ROP value in response to presenting the HCE values. In some embodiments, a first mud property sensor and a second mud property sensor are coupled to the control system, where the first mud property sensor acquires density data regarding an initial drilling fluid, and wherein the second mud property sensor acquires density data regarding a wellbore drilling fluid at a respective segment length.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
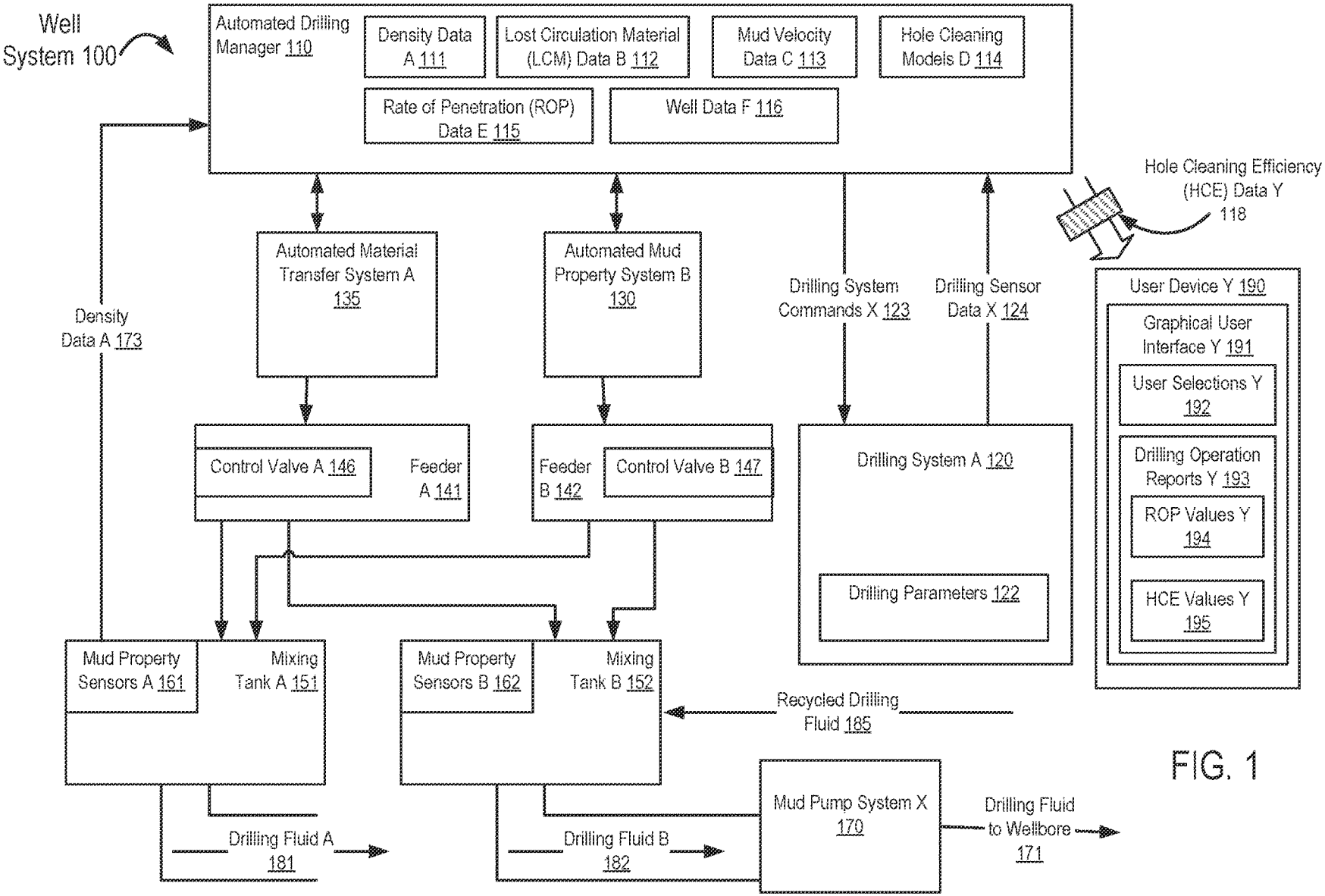
FIGS. 1, 2, and 3 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for using density data regarding initial drilling fluid and wellbore drilling fluid to determine hole cleaning efficiency (HCE) values for a wellbore. In some embodiments, for example, cuttings weights and mud velocities may be determined for specific intervals or specific formations in the subsurface. More specifically, a wellbore may be divided among various segment lengths, where an individual segment length may have a particular HCE value calculated at a particular time step in the drilling operation. Using density data and flow rate data from mud sensors at the corresponding segment length, cutting weights and mud velocities may be determined accordingly. Based on the HCE values, various parameters of a drilling operation may be adjusted, such as rate of penetration (ROP) values or the flow rate of the drilling fluid circulating in a wellbore. Likewise, lost circulation materials may also be applied in a drilling operation to remedy any HCE values that fail predetermined criteria, such as a passing threshold.

In some embodiments, an automated drilling manager capitalizes on drilling fluid's kinetic energy, mud lifting force, shear drag force, gravity force, and buoyant force to accurately estimate the hole cleaning efficiency values. Using real-time density data and rpm data, for example, an automated process may assist end users to ensure adequate mud weight and safely drill with narrow mud windows to avoid fluid losses or kicks in a drilling operation. Some embodiments may estimate various cuttings weight values and hole cleaning efficiency values for wellbores that may not have any equipment to measure cuttings' sizes or weights. Likewise, some embodiments may assist in avoiding surge/swab problems in drilling operations.

Furthermore, "initial drilling fluid" may refer to clean drilling fluid prior to entering a wellbore. Likewise, "initial drilling fluid" may refer to treated or recycled drilling fluid that is acquired from a wellbore and prior to being returned to the wellbore for use in a drilling operation. On the other hand, density data may also be collected for "wellbore drilling fluid", which may refer to drilling fluid located circulating at one or more segment lengths in a respective wellbore.

Turning to FIG. 1, FIG. 1 shows a schematic diagram in accordance with one or more embodiments. As shown in FIG. 1, FIG. 1 illustrates a well system (100) that may include an automated drilling manager (e.g., automated drilling manager (110)) coupled to one or more user devices (e.g., user device (190)), a drilling system (e.g., drilling system A (120)), a mud pump system (e.g., mud pump system X (170)), an automated material transfer system (e.g., automated material transfer system A (135)), an automated mud property system (e.g., automated mud property system B (130)), and various drilling fluid processing components. For example, drilling fluid processing equipment may include one or more feeders (e.g., feeder A (141), feeder B (142)), one or more control valves (e.g., control valve A (146), control valve B (147)), one or more mixing tanks (e.g., mixing tank A (151), mixing tank B (152)), and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system.

With respect to the drilling system, drilling fluid may circulate through a drill string for continuous drilling, e.g., drilling fluid A (181) and drilling fluid B (182) as shown in FIG. 1, in order to circulate through a wellbore (e.g., drilling fluid to wellbore (171)). In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters (122)) such as drill pipe rotary speed (RPM), pipe eccentricity (i.e. axial location of the drill pipe), hole inclination angle, and rate of penetration (ROP). Likewise, used drilling fluid from a wellbore may be passed through a solid removal system prior to entering a mixing tank or being sent to a mud pump system. More specifically, a solid removal system may include equipment and other hardware for removing particular solids, such as drill cuttings and coarse aggregates, from used drilling fluid in order to recycle drilling fluid (e.g., recycled drilling fluid (185)). For more information on drilling systems, see FIG. 2 and the accompanying description below.

In some embodiments, an automated drilling manager includes functionality for using one or more hole cleaning models (e.g., hole cleaning models D (114)) to determine one or more hole cleaning efficiency (HCE) values. For example, a hole cleaning model may describe how drilling fluids under various laminar-flow regimes remove cuttings produced from drilling. As such, a hole cleaning model may characterize hole cleaning efficiency in the eccentric annuli of extended-reach well bores, evaluate drilling fluid performance, and/or predict various fluid rheological properties for optimum cleaning. Accordingly, hole cleaning models may be used in prewell planning as well as analyzing the cleaning state of a wellbore in real-time. Thus, efficient hole cleaning may affect the quality of directing and extended-reach drilling operations. In some embodiments, an HCE value is determined using mud velocity data and cuttings weights of a wellbore drilling fluid at a respective segment length or segment volume of a wellbore. Likewise, HCE values may be associated with different thresholds for describing various cleaning states of a well. In some embodiments, an automated drilling manager may use this aggregated drilling operation data, well data (e.g., well data F (116)) such as borehole diameters, and drilling fluid data to merge analytical operations with a drilling simulator or well control simulator for understanding how the downhole environment changes while drilling. For more information on hole cleaning models and HCE values, see Block 420 in FIG. 4 and the accompanying description below.

In some embodiments, an automated drilling manager transmits one or more commands (e.g., drilling system commands X (123)) to various control systems in a well system (e.g., drilling system A (120), automated material transfer system A (135), automated mud property system B (130)) in order to produce drilling operations with specific drilling parameters and/or produce drilling fluids (e.g., drilling fluid A (181), drilling fluid B (182), recycled drilling fluid (185)) having specific drilling fluid properties, such as predetermined density values or mud velocity values. Commands may include data messages transmitted over one or more network protocols using a network interface, such as through wireless data packets. Likewise, a command may also be a control signal, such as an analog electrical signal, that triggers one or more operations in a particular control system (e.g., drilling system A (120)).

Furthermore, drilling fluid data (e.g., density data A (111), lost circulation material (LCM) data B (112), mud velocity data C (113)) may correspond to different physical qualities associated with drilling mud, such as specific gravity values (also referred to as mud weight or mud density), viscosity levels, pH levels, rheological values such as flow rates, temperature values, resistivity values, mud mixture weights, mud particle sizes, mud pressures, mud velocities, and various other attributes that affect the role of drilling fluid in a wellbore. For example, a drilling fluid property may be selected by a user device to have a desired predetermined rheological value, which may include a range of acceptable values, a specific threshold value that should be exceeded, a precise scalar quantity, etc. As such, an automated drilling manager or another control system may obtain sensor data (e.g., density data A (173)) from various mud property sensors (e.g., mud property sensors A (161), mud property sensors B (162)) regarding various drilling fluid property parameters. Examples of mud property sensors include pH sensors, density sensors, rheological sensors, volume sensors, weight sensors, flow meters, such as an ES flow sensor, etc. Likewise, sensor data may refer to both raw sensor measurements and/or processed sensor data associated with one or more drilling fluid properties.

With respect to mud pump systems, a mud pump system (e.g., mud pump system X (170)) may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

With respect to mixing tanks, a mixing tank may be a container or other type of receptacle (e.g., a mud pit) for mixing various liquids, fresh mud, recycled mud (e.g., recycled drilling fluid (185)), additives, and/or other chemicals to produce a particular type of drilling fluid (e.g., drilling fluid A (181), drilling fluid B (182)). For example, a mixing tank may be coupled to one or more mud supply tanks, one or more additive supply tanks, one or more dry/wet feeders (e.g., feeder A (141), feeder B (142)), and one or more control valves (e.g., control valve A (146), control valve B (147)) for managing the mixing of chemicals within a respective mixing tank. Control valves may be used to meter chemical inputs into a mixing tank, as well as release drilling fluid into a mixing tank. Likewise, a mixing tank may include and/or be coupled to various types of drilling fluid equipment not shown in FIG. 1, such as various mud lines, liquid supply lines, and/or other mixing equipment.

In some embodiments, a well system includes an automated material transfer system (e.g., automated material transfer system A (135)). In particular, an automated material transfer system may be a control system with functionality for managing supplies of bulk powder and other inputs for producing a preliminary mud mixture. For example, an automated material transfer system may include a pneumatic, conveyer belt or a screw-type transfer system (e.g., using a screw pump) that transports material from a supply tank upon a command from a sensor-mediated response. Thus, the automated material transfer system may monitor a mixing tank using weight sensors and/or volume sensors to meter a predetermined amount of bulk powder to a selected mixing tank.

Likewise, a well system may also include an automated mud property system (e.g., automated mud property system B (130)) to control the supply of various additives to a mixing tank. In some embodiments, for example, an automated mud property system may include hardware and/or software with functionality for automatically supplying and/or mixing weighting agents, buffering agents, rheological modifiers, and/or other additives until a mud mixture matches and/or satisfies one or more desired drilling fluid properties. Examples of weighting agents may include barite, hematite, calcium carbonate, siderite, etc. A buffering agent may be a pH buffering agent that causes a mud mixture to resist changes in pH levels. For example, a buffering agent may include water, a weak acid (or weak base) and salt of the weak acid (or a salt of weak base). Rheological modifiers may include drilling fluid additives that adjust one or more flow properties of a drilling fluid. One type of rheological modifier is a viscosifier, which may be an additive with functionality for providing thermal stability, hole-cleaning, shear-thinning, improving carrying capacity as well as modifying other attributes of a drilling fluid. Examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

Furthermore, an automated drilling manager may monitor various drilling fluid properties and drilling parameters in real-time. For example, drilling fluid properties may be monitored using one or more mud property sensors. Likewise, drilling parameters may be modified in real-time based on downhole sensors, drilling sensors (e.g., using drilling sensor data X (124)), etc. In some embodiments, for example, the automated drilling manager modifies drilling fluid properties and drilling parameters at predetermined intervals until user-defined properties are achieved by the well system (100). The user-defined properties may correspond to a selection by a user device (e.g., user selection Y (192) obtained by user device Y (190) using a graphical user interface Y (191)). For example, an automated drilling manager may be coupled to a user device e.g., over a well network, or remotely (e.g., through a remote connection using Internet access or a wireless connection at a well site). Based on real-time updates received for a current drilling operation, a user and/or the automated drilling manager may modify previously-selected drilling fluid property values and/or drilling parameters, e.g., in response to changes in drilling fluid within the wellbore.

Keeping with FIG. 1, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager (110), the automated material transfer system A (135), the automated mud property system B (130), and/or the user device (190) may include a computer system that is similar to the computer system (702) described below with regard to FIG. 7 and the accompanying description.

During some well operations, a lost circulation event may occur that results in a partial or complete loss of drilling fluid and/or cement slurry into a formation. For example, a lost circulation event may be brought on by natural causes or induced causes within the formation. Natural causes may include naturally-occurring fractures or caverns adjacent to a wellbore as well as unconsolidated zones. Induced causes may include a situation when a hydrostatic fluid pressure exceeds a fracture gradient of the formation resulting in a fracture receiving fluid rather than resisting the fluid. When drilling into highly fractured formations, for example, severe fluid losses may be encountered that pose serious threats to drilling operations. Fluid losses may lead to various risks such as high costs of replacing drilling fluid during the drilling operation, formation damage left behind by lost circulation treatments, and even a possible loss of hydrostatic pressure that can cause an influx of gas or fluid, e.g., resulting in a well blowout.

With respect to drilling operations, various types of lost circulation material (LCMs) may be used in a lost circulation treatment to prevent or reduce drilling fluids from being lost inside downhole formations. LCM examples may include fibrous materials (e.g., cedar bark, shredded cane stalks, mineral fiber, and hair), flaky materials (e.g., mica flakes, pieces of plastic, and cellophane sheeting) or granular materials (e.g., ground and sized materials such as limestone, marble, wood, nut hulls, Formica, corncobs, and cotton hulls). A fibrous LCM may include long, slender and flexible substances that are insoluble and inert, where the fibrous material may assist in retarding drilling fluid loss into fractures or highly permeable zones. A flaky LCM may be thin and flat in shape with a large surface area in order to seal off fluid loss zones in a wellbore and help stop lost circulation. A granular LCM may be chunky in shape with a range of particle sizes. LCMs may also include one or more bridging agents that may include solids added to a drilling fluid to bridge across a pore throat or fractures of an exposed rock thereby producing a filter cake to prevent drilling fluid loss or excessive filtration. Example bridging agents may include removable-common products include calcium carbonate (acid-soluble), suspended salt (water-soluble) or oil-soluble resins. In some embodiments, granular materials, flaky materials, and/or fibrous materials are combined into an LCM pill and pumped into a wellbore next to a zone experiencing fluid loss to seal the formation.

In regard to automated mud processing systems, an automated mud processing system may include a controller coupled various feeders, various control valves, various mixing tanks, and/or a solid removal system for managing drilling fluid in a drilling operation. The controller may include hardware, such as a processor, coupled to various sensors around various well systems at a well site. With respect to a mixing tank, a mixing tank may be a container or other type of receptacle (e.g., a mud pit) for mixing various liquids, fresh mud, recycled mud, different types of LCMs, additives, and/or other chemicals to produce a particular drilling fluid mixture. For example, a mixing tank may be coupled to one or more mud supply tanks, one or more additive supply tanks, one or more dry/wet feeders, and one or more control valves for managing the mixing of chemicals within a respective mixing tank. Control valves may be used to meter chemical inputs into a mixing tank, as well as release drilling fluid into a mixing tank.

Figure 2:
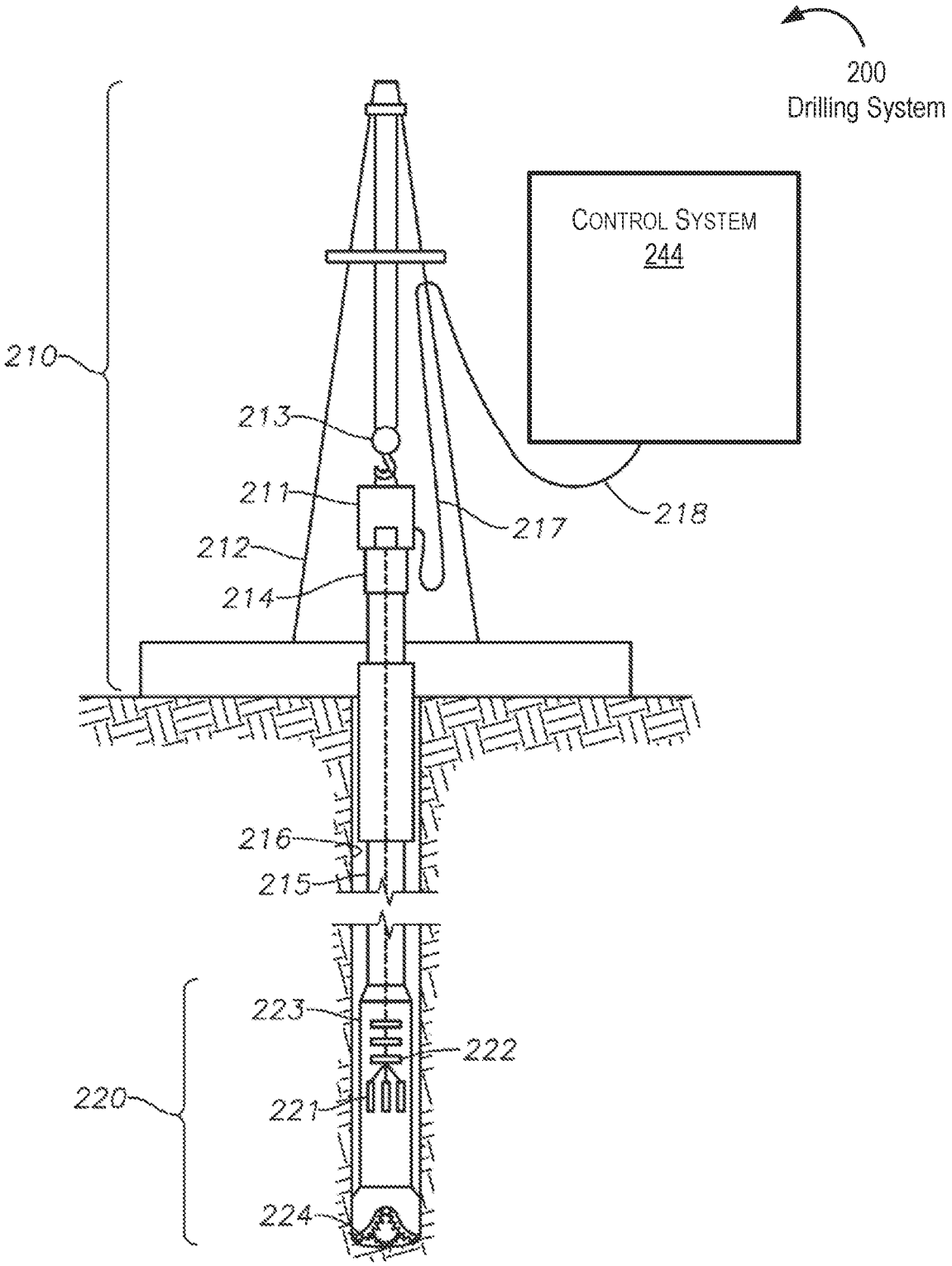

Turning to FIG. 2, FIG. 2 illustrates a system in accordance with one or more embodiments. As shown in FIG. 2, a drilling system (200) may include a top drive drill rig (210) arranged around the setup of a drill bit logging tool (220). A top drive drill rig (210) may include a top drive (211) that may be suspended in a derrick (212) by a travelling block (213). In the center of the top drive (211), a drive shaft (214) may be coupled to a top pipe of a drill string (215), for example, by threads. The top drive (211) may rotate the drive shaft (214), so that the drill string (215) and a drill bit logging tool (220) cut the rock at the bottom of a wellbore (216). A power cable (217) supplying electric power to the top drive (211) may be protected inside one or more service loops (218) coupled to a control system (244). As such, drilling fluid may be pumped into the wellbore (216) using the drive shaft (214) and/or the drill string (215). Likewise, the drilling system may also include a mud pump, a mud line, mud pits, a mud return, and other components related to the circulation or recirculation of drilling fluid within the wellbore (216). The control system (244) may be similar to various control systems described above in FIG. 1 and the accompanying description, such as the automated drilling manager (110), the automated material transfer system A (135) and/or the automated mud property system B (130).

Moreover, when completing a well, casing may be inserted into the wellbore (216). The sides of the wellbore (216) may require support, and thus the casing may be used for supporting the sides of the wellbore (216). As such, a space between the casing and the untreated sides of the wellbore (216) may be cemented to hold the casing in place. The cement may be forced through a lower end of the casing and into an annulus between the casing and a wall of the wellbore (216). More specifically, a cementing plug may be used for pushing the cement from the casing.

For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

As further shown in FIG. 2, sensors (221) may be included in a sensor assembly (223), which is positioned adjacent to a drill bit (224) and coupled to the drill string (215). Sensors (221) may also be coupled to a processor assembly that includes a processor, memory, and an analog-to-digital converter (222) for processing sensor measurements. For example, the sensors (221) may include acoustic sensors, such as accelerometers, measurement microphones, contact microphones, and hydrophones. Likewise, the sensors (221) may include other types of sensors, such as transmitters and receivers to measure resistivity, gamma ray detectors, etc. The sensors (221) may include hardware and/or software for generating different types of well logs (such as acoustic logs or density logs) that may provide well data about a wellbore, including porosity of wellbore sections, gas saturation, bed boundaries in a geologic formation, fractures in the wellbore or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (200) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The control system (244) may be coupled to the sensor assembly (223) in order to perform various program functions for up-down steering and left-right steering of the drill bit (224) through the wellbore (216). More specifically, the control system (244) may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit (224) or drill string (215) relative to a boundary between different subsurface layers (e.g., overlying, underlying, and lateral layers of a pay zone) during drilling operations. In particular, measuring rock properties during drilling may provide the drilling system (200) with the ability to steer the drill bit (224) in the direction of desired hydrocarbon concentrations. As such, a geo steering system may use various sensors located inside or adjacent to the drill string (215) to determine different rock formations within a well path. In some geosteering systems, drilling tools may use resistivity or acoustic measurements to guide the drill bit (224) during horizontal or lateral drilling.

In some embodiments, a user device (e.g., user device Y (190) may provide a graphical user interface (e.g., graphical user interface Y (191)) for communicating with an automated drilling manager, e.g., to monitor drilling operations, drilling fluid operations, and hole cleaning efficiency data (e.g., HCE data Y (115)). For example, a user device may be a personal computer, a human-machine interface, a smartphone, or another type of computer device for presenting information and obtaining user inputs in regard to the presented information. Likewise, the user device may obtain various user selections (e.g., user selections Y (192)) in regard to drilling operations, drilling fluid operations, and/or hole cleaning operations. Likewise, the user device may display various reports that may include charts as well as other arrangements of well data (e.g., drilling operation reports Y (193) includes ROP values Y (194) and HCE values Y (195)).

Figure 3:
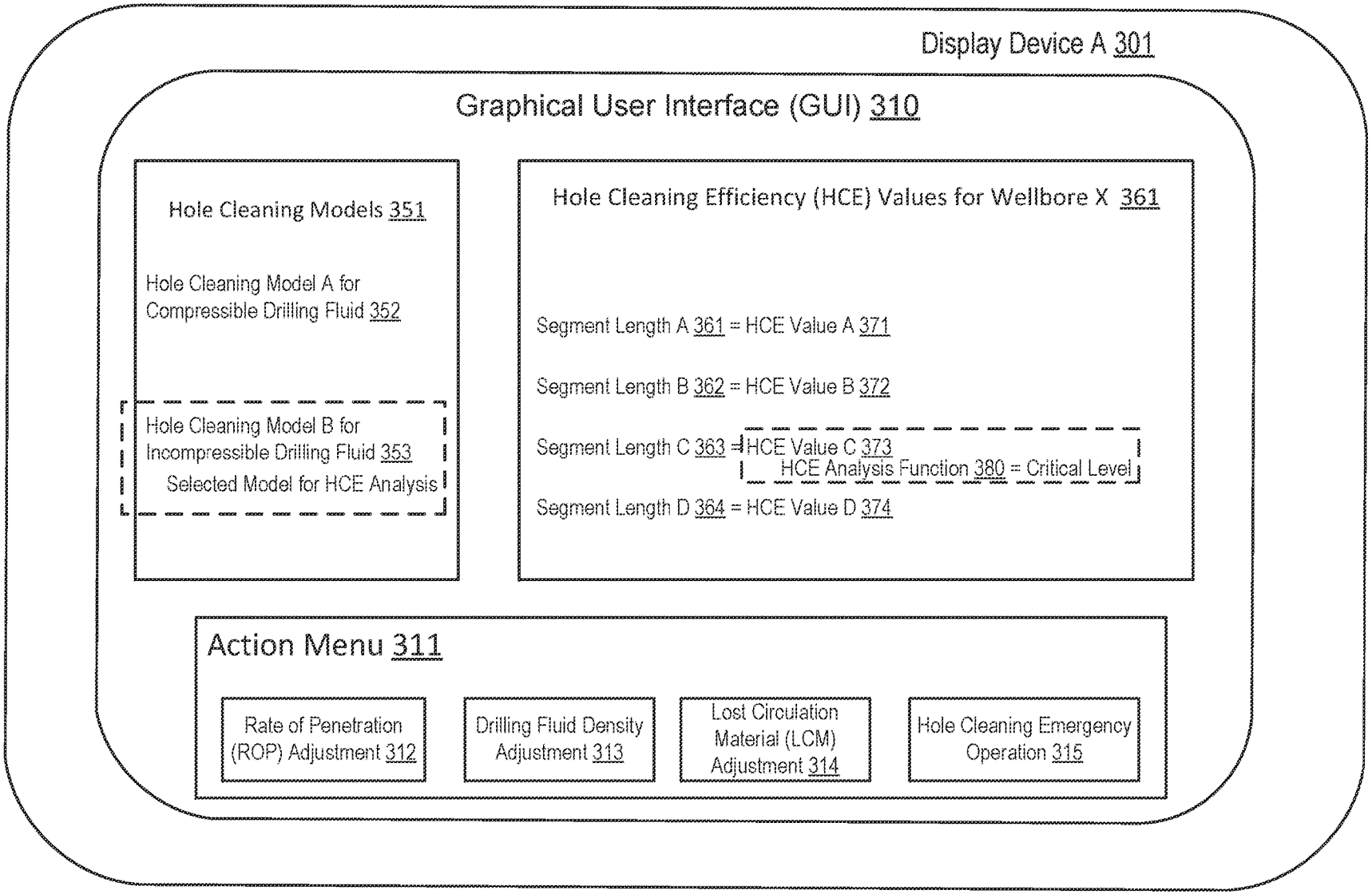

Turning to FIG. 3, FIG. 3 illustrates an example of monitoring hole cleaning states at various segment lengths of a wellbore and through a user interface in accordance with one or more embodiments. In FIG. 3, a graphical user interface (GUI) (310) is provided on a display device A (301) of a user device (not shown). As shown in FIG. 3, a user may select one of the hole cleaning models (351) (e.g., a hole cleaning model A (352) for compressible drilling fluid and a hole cleaning model B (353) for incompressible drilling fluid) using the GUI (310). After the user selection, the GUI may provide information based on the selected model for a hole cleaning efficiency analysis. For example, the GUI (310) presents hole cleaning efficiency (HCE)

values (361) for wellbore X, such as HCE value A (371) for segment length A (361), HCE value B (372) for segment length B (362), HCE value C (373) for segment length C (363), and HCE value D (374) for segment length D (364). As shown in FIG. 3, the HCE values may be analyzed with an HCE analysis function (380) to determine whether any values fail to satisfy a predetermined criterion, such as falling below a critical level for the wellbore X. Here, an automated drilling manager identifies HCE value C (373) as failing a corresponding predetermined criterion using the HCE analysis function (380).

Keeping with FIG. 3, in some embodiments, an automated drilling manager provides an action menu (311) to a user for selecting one or more commands based on an HCE analysis or other HCE information. For example, the action menu (311) may be a GUI window that automatically provides various recommendation options based on various predetermined criteria. In particular, the GUI (310) may provide commands to perform a ROP adjustment (312), a drilling fluid density adjustment (313), a command to perform a lost circulation material (LCM) adjustment (314), or a hole cleaning emergency operation (315).

While FIGS. 1, 2, and 3 shows various configurations of components, other configurations may be used without departing from the scope of the disclosure. For example, various components in FIGS. 1, 2, and 3 may be combined to create a single component. As another example, the functionality performed by a single component may be performed by two or more components.

Figure 4:
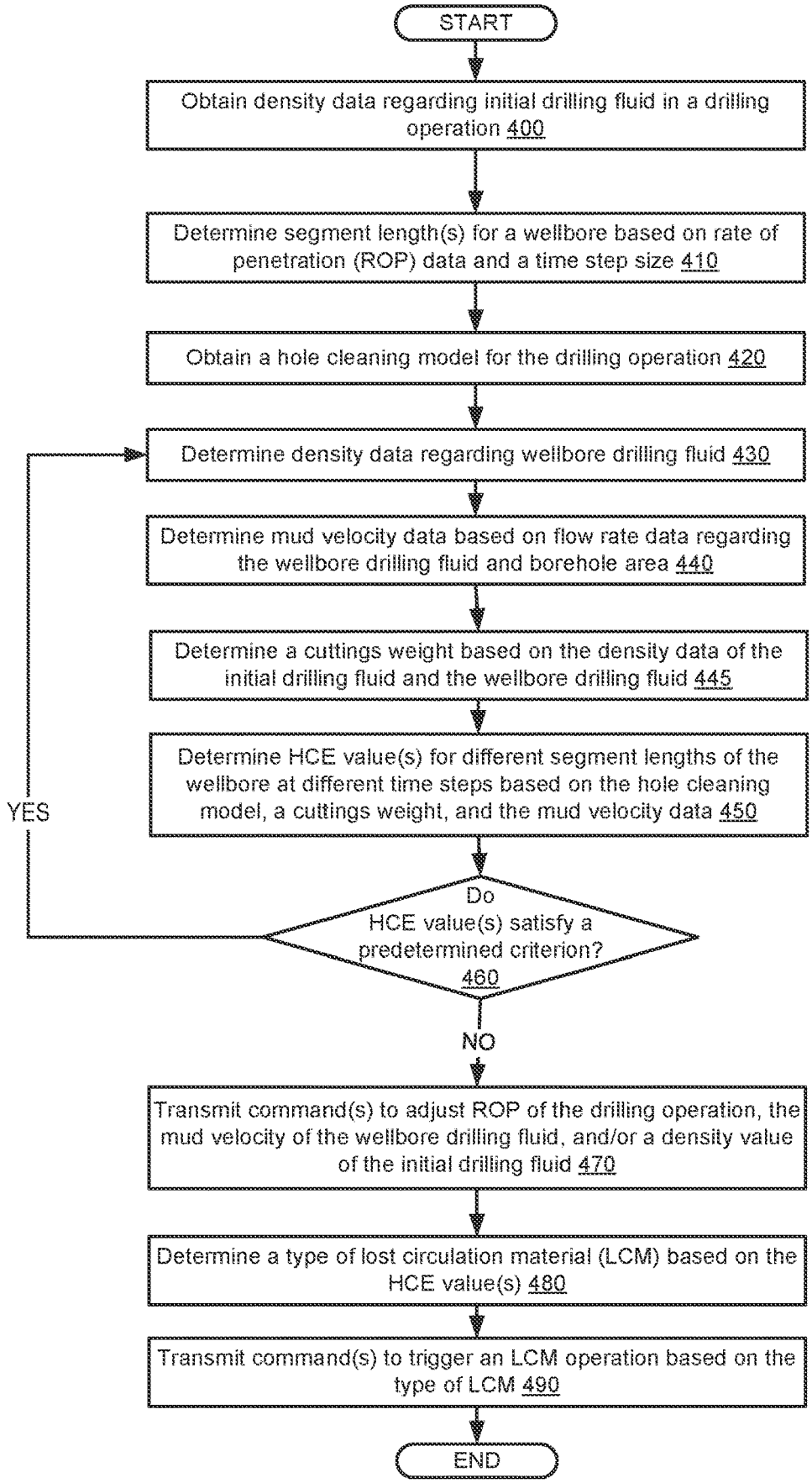
FIG. 4 shows a flowchart in accordance with one or more embodiments.

Turning to FIG. 4, FIG. 4 shows a flowchart in accordance with one or more embodiments. Specifically, FIG. 4 describes a general method for managing a drilling operation based on various hole cleaning efficiency values. One or more blocks in FIG. 4 may be performed by one or more components (e.g., automated drilling manager (110)) as described in FIGS. 1, 2, and 3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, density data is obtained regarding an initial drilling fluid in a drilling operation in accordance with one or more embodiments. For example, an automated drilling manager may collect density data from various sensors throughout a well site, e.g., from drilling fluid processing equipment as well as downhole in a wellbore.

Furthermore, after density data and other rheology measurements are acquired for a drilling fluid, a drilling fluid flow may start from a mud tank at the well surface. The density data and other rheology data may be taken constantly (e.g., at periodic intervals) after a specific period of time called a time-step (TS). The distance that the mud travels along the wellbore trajectory may depend on the Rate of Penetration (ROP).

In Block 410, one or more segment lengths are determined for a wellbore based on a rate of penetration (ROP) data and a time step size in accordance with one or more embodiments. In particular, a segment length may be defined as a distance travelled by a drill bit at a predetermine rate (i.e., $ROP_j$) that is defined as the current segment length ($SL_j$) during a particular time step TS. Thus, the distance at an initial time step may be a single segment length. For example, the time step (i.e., TS ($\Delta t$)) may be 1 minute. In some embodiments, a size of a time step (TS) is selected based on the frequency that density measurements are updated for the drilling fluid (e.g., a time step of 1 minute may be used where density data is collected regarding wellbore drilling fluid every 1 minute). In some embodiments, a segment length of a drilling operation is determined using Equation 1:

$$SL_j = \frac{TS \times ROP_j}{60} \quad \text{Equation 1}$$

where $SL_j$ corresponds to a segment length of a wellbore (e.g., ft), $ROP_j$ corresponds to a rate of penetration of a drill string during a drilling operation at segment j, and TS corresponds to a particular time step.

Figure 5:
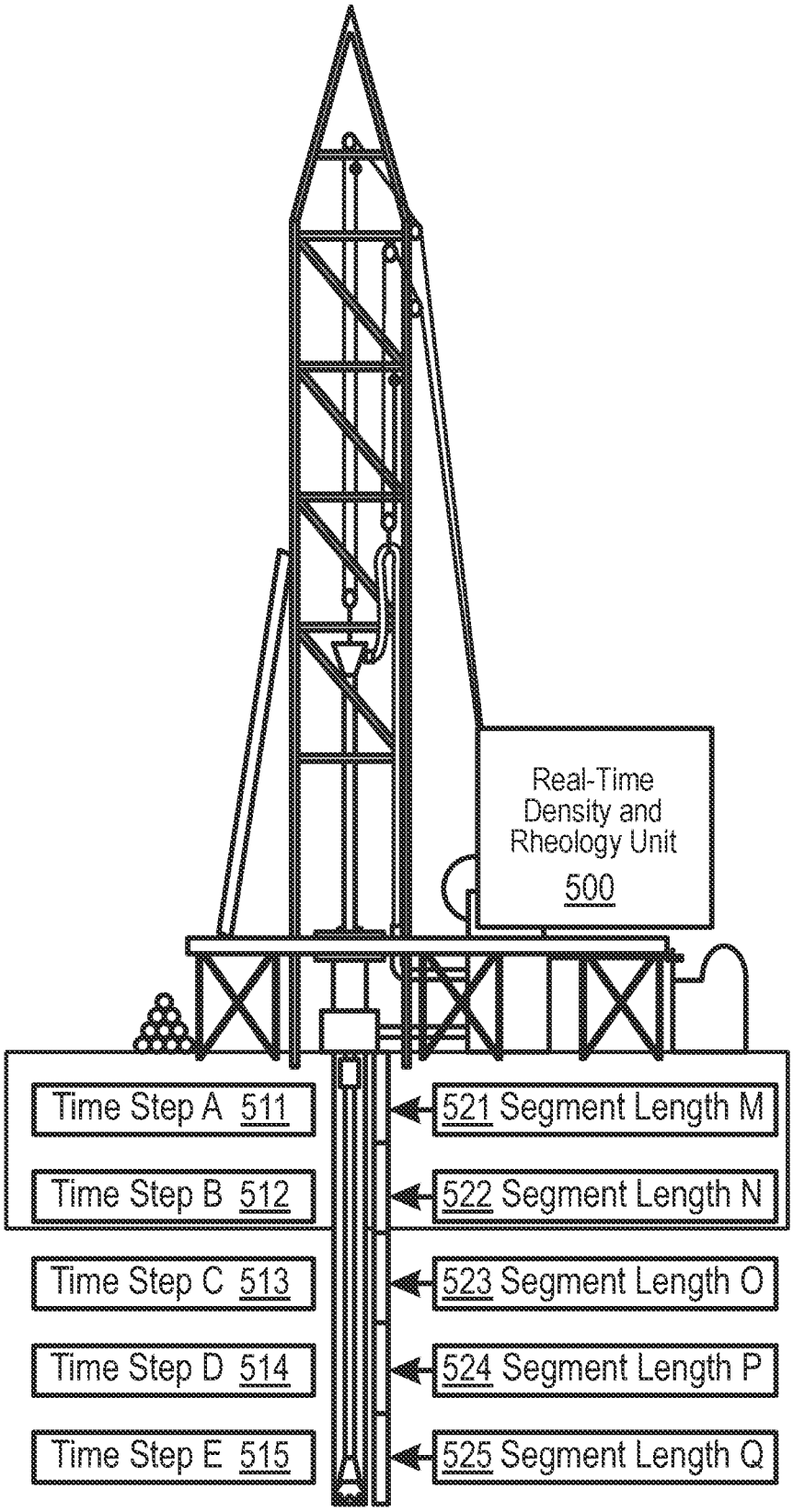
FIG. 5 shows an example in accordance with one or more embodiments.

Turning to FIG. 5, FIG. 5 illustrates an example of a wellbore divided into various segment lengths in accordance with one or more embodiments. In FIG. 5, a wellbore is divided into segment length M (521), segment length N (522), segment length O (523), segment length P (524), and segment length Q (525). As such, segment length M (521) corresponds to time step A (511), segment length N (522) corresponds to time step B (512), segment length O (523) corresponds to time step C (513), segment length P (524) corresponds to time step D (514), segment length Q (525) corresponds to time step E (515). Accordingly, a real-time density and rheology unit (500) may be used to determine HCE values for the segment lengths (521, 522, 523, 524).

Returning to FIG. 4, in Block 420, a hole cleaning model is obtained for a drilling operation in accordance with one or more embodiments. In particular, a hole cleaning model may use real-time sensor data to determine one or more hole cleaning efficiency values for a respective segment length of a wellbore. In particular, a hole cleaning model may estimate the amount of cuttings in a drilling fluid flow based on the changes in the mud density and viscosity. In some embodiments, a hole cleaning model is expressed using the following equation:

$$HCE(t, j) = \frac{\text{cuttings weight} \times v_{mud} \times \Delta t}{SL_j} \quad \text{Equation 2}$$

where HCE(t,j) corresponds to a hole cleaning efficiency value that is a function of time t and a particular segment j of a wellbore. More specifically, hole cleaning efficiency may be determined iteratively by analyzing a current segment length $SL_j$, where HCE values may be measured weight of cuttings resulting from circulation of drilling fluid per unit length (e.g., mud/ft) within segment j. Furthermore, Equation 3 may be derived based on the Newton's second law of motion. For example, work may be determined using the following equation:

$$W = F \times D \quad \text{Equation 3}$$

Where work W may be a product of force F and distance D (e.g., lbf·ft). Equation 3 above may be rewritten using the following equations:

$$W = M \times \frac{v_f^2 - v_i^2}{2D} \times D = \frac{1}{2} \times M \times \Delta v^2 \quad \text{Equation 4}$$

$$W_{net} = \Delta K \quad \text{Equation 5}$$

$$K = \frac{1}{2} \times M \times v^2 \quad \text{Equation 6}$$

where K corresponds to the kinetic energy to move drilling fluid in a circulation system (e.g., lbf·ft), W corresponds to an amount of work done by drilling fluid pumped from the well's surface to the bottom of a wellbore (e.g., lbf·ft), F corresponds to an amount of force applied to the drilling fluid by the pump (e.g., lbf), $v_i$ corresponds to an initial mud flow velocity (e.g., ft/s), $v_f$ corresponds to a final mud flow velocity (e.g., ft/s), D corresponds to a distance that the drilling fluid flows in the wellbore, and M is a mass of the drilling fluid. For example, mass M may correspond to moving mud contaminated with drilled cuttings in the annulus, i.e., "dirty mud".

In some embodiments, a hole cleaning model describes HCE values regarding a compressible drilling fluid. In case of compressible drilling fluid flow:

$$a = \sqrt{\frac{\gamma P}{\rho_{dirty-mud,j}}} \quad \text{Equation 7}$$

$$M = \frac{u}{a} \quad \text{Equation 8}$$

where a corresponds to the speed of sound (e.g., ft/s), M corresponds to Mach number (non-dimensional), $\gamma$ corresponds to a ratio of specific heat (non-dimensional) (e.g., 1.4 for air at sea-level conditions), u corresponds to a flow rate (e.g., ft/s) of the drilling fluid, and P corresponds to a drilling fluid pressure (e.g., psi). In some embodiments, for example, a dynamic pressure $P_{dynamic,j}$ is determined for a particular segment j using the following equation:

$$P_{dynamic,j} = \frac{1}{2} \times \gamma \times M^2 \times p \quad \text{Equation 9}$$

where p corresponds to a static pressure of a drilling fluid (e.g., psi), $\gamma$ corresponds to a ratio of specific heat (non-dimensional) (e.g., 1.4 for air at sea-level conditions), and M corresponds to Mach number (non-dimensional).

Returning to FIG. 4, in Block 430, density data are determined regarding wellbore drilling fluid in accordance with one or more embodiments. For example, density data may be acquired using one or more mud property sensors disposed in the wellbore or proximate drilling fluid exiting the wellbore.

In Block 440, mud velocity data are determined based on flow rate data regarding wellbore drilling fluid and a borehole area in accordance with one or more embodiments. For example, an automated drilling manager may obtain real-time flow rate data regarding drilling fluid in a wellbore, e.g., from various flow rate sensors. As such, mud velocity data may be determined using flow rate data. In some embodiments, a mud velocity of the drilling fluid is determined using the following equation:

$$v_{mud} = Q_{mud}/A \quad \text{Equation 10}$$

where $Q_{mud}$ corresponds to a flow rate along the wellbore trajectory (e.g., $ft^3/s$), and A corresponds to a cross sectional area of the current segment $S_j$ of the drilling sections of the wellbore. For example, A may be a borehole area based on a radius of the current segment.

In Block 445, a cuttings weight is determined for wellbore drilling fluid based on density data in accordance with one or more embodiments. In particular, a cuttings weight may be determined based on a difference between the initial mass of the drilling fluid entering the wellbore and the current mass of the drilling fluid within a segment of the wellbore. In some embodiments, a cuttings weight is determined using density data regarding the density of initial drilling fluid and density data regarding the wellbore drilling fluid.

$$\text{cuttings weight(CW)} = \text{dirty mud mass} - \text{clean mud mass} \quad \text{Equation 11}$$

where $\rho_{fresh-mud}$ corresponds to an initial mud density value determined before drilling, and $\rho_{dirty-mud}$ corresponds to a mud density value estimated (e.g., by an automated drilling manager) after drilling a section of a wellbore. In some embodiments, a mass of an initial drilling fluid and a wellbore drilling fluid are determined using the following equations:

$$\text{clean mud mass} = \rho_{fresh-mud} \times V_j \quad \text{Equation 12}$$

$$\text{dirty mud mass} = \rho_{dirty-mud} \times V_j \quad \text{Equation 13}$$

where the clean mud mass is the mass of an initial drilling fluid, a dirty mud mass is a mass of a wellbore drilling fluid, and $V_j$ corresponds to a segment volume of a respective segment length. At a current segment j, for example, an automated drilling manager may determine the $\rho_{dirty-mud}$, and $\rho_{fresh-mud}$ at time step i. In some embodiments, the segment volume may be determined using the following equation:

$$V_j = \pi r^2 SL_j \quad \text{Equation 14}$$

where r corresponds to a borehole radius of the wellbore (e.g., in inches) through which the mud flows, and $SL_j$ corresponds to a segment length.

In Block 450, one or more hole cleaning efficiency (HCE) values are determined for different segment lengths of a wellbore at different time steps based on a hole cleaning model, a cuttings weight, and mud velocity data in accordance with one or more embodiments. In some embodiments, an automated drilling manager uses Equation 2 above to iteratively determine multiple HCE values at different time steps of a drilling operation. An automated drilling manager may use the HCE values to determine any inefficient removal of drilled cuttings that may result in many problems for a drilling operation. For example, potential problems may include early drill bit wear, slow drilling rates, poor cementing operations, and even stuck pipe risks that may lead to complete loss of a well. By automating the hole cleaning process, an automated drilling manager may reduce the stuck-pipe risks and alert control systems and human personnel to dangers before a hole cleaning state becomes critical for a drilling operation. Therefore, hole cleaning efficiency may become a significant aspect for optimizing a drilling operation.

In Block 460, a determination is made whether one or more HCE values satisfy a predetermined criterion in accordance with one or more embodiments. In some embodiments, an automated drilling manager initiates one or more adjustments of a drilling operation in response to determining that one or more of the HCE values fails to satisfy one or more predetermined criteria (e.g., a threshold of an HCE value). Examples of predetermined criterion may correspond to different ranges of HCE values that represent a clean hole (i.e., a clean hole threshold), a critical range approaching problems with a drilling operations (i.e., a critical interval threshold), and/or a problem range that corresponds to dangerous conditions for a drilling operations (i.e., a problem interval threshold). When a determination is made that all of the HCE values satisfy one or more predetermined criterion, the process may return to Block 430. When a determination is made that at least one of the HCE values fails to satisfy a predetermined criterion, the process may proceed to Block 470.

In Block 470, one or more commands are transmitted to adjust a rate of penetration (ROP) of a drilling operation, a mud velocity value of a wellbore drilling fluid, and/or a density value of an initial drilling fluid in accordance with one or more embodiments. For example, a user or an automated drilling manager may select different ROP values to achieve different HCE values. A user selection may be obtained within a graphical user interface and be part of the request from a user device to adjust the current ROP value. In another example, a user device or a control system in a well system may automatically determine an adjusted ROP value that satisfies one or more drilling parameters in addition to a specified HCE value, e.g., based on a formation type or a particular well path design.

In some embodiments, an automated drilling manager transmits a command to a mud pump system or other mud system in order to change a flow rate or mud velocity of a wellbore drilling fluid. Likewise, one or more commands may be transmitted to one or more control systems to adjust a density value of initial drilling fluid (e.g., recycled drilling fluid or unused drilling fluid).

In Block 480, a type of lost circulation material (LCM) is determined based on one or more HCE values in accordance with one or more embodiments. For example, an automated drilling manager or other control system may use a real-time acquisition of HCE values to monitor well operations and address lost circulation events. Based on real-time changes in HCE values, for example, an automated drilling manager may determine specific drilling fluid properties to prevent or reduce a lost circulation event or increasing hole cleaning in a wellbore. Accordingly, one or more LCMs may be selected for addition or substitution to the current drilling fluid being used.

In Block 490, one or more commands are transmitted to trigger an LCM operation based on a type of an LCM in accordance with one or more embodiments. For example, a command may be fashioned correspond to a particular parameter value for a selected LCM. Thus, the command may be a control signal, e.g., generated by a control system, or a network message that adjusts one or more drilling fluid parameters and/or cementing parameters. For example, a command may be transmitted from an automated drilling manager or control system at a well site to one or more mud systems, such as an automated mud processing system, or one or more drilling systems.

In some embodiments, one or more commands are transmitted to one or more mud pump systems that adjust one or more pump pressures in response to one or more HCE values. Likewise, commands may be transmitted based on other drilling fluid factors, such as mud lift capacity, kinetic energy of cuttings in the drilling fluid, etc.

In regard to automated mud processing systems, an automated mud processing system may include a controller coupled various feeders, various control valves, various mixing tanks, and/or a solid removal system for managing drilling fluid in a drilling operation. The controller may include hardware, such as a processor, coupled to various sensors around various well systems at a well site. With respect to a mixing tank, a mixing tank may be a container or other type of receptacle (e.g., a mud pit) for mixing various liquids, fresh mud, recycled mud, different types of LCMs, additives, and/or other chemicals to produce a particular drilling fluid mixture. For example, a mixing tank may be coupled to one or more mud supply tanks, one or more additive supply tanks, one or more dry/wet feeders, and one or more control valves for managing the mixing of chemicals within a respective mixing tank. Control valves may be used to meter chemical inputs into a mixing tank, as well as release drilling fluid into a mixing tank.

Figure 6:
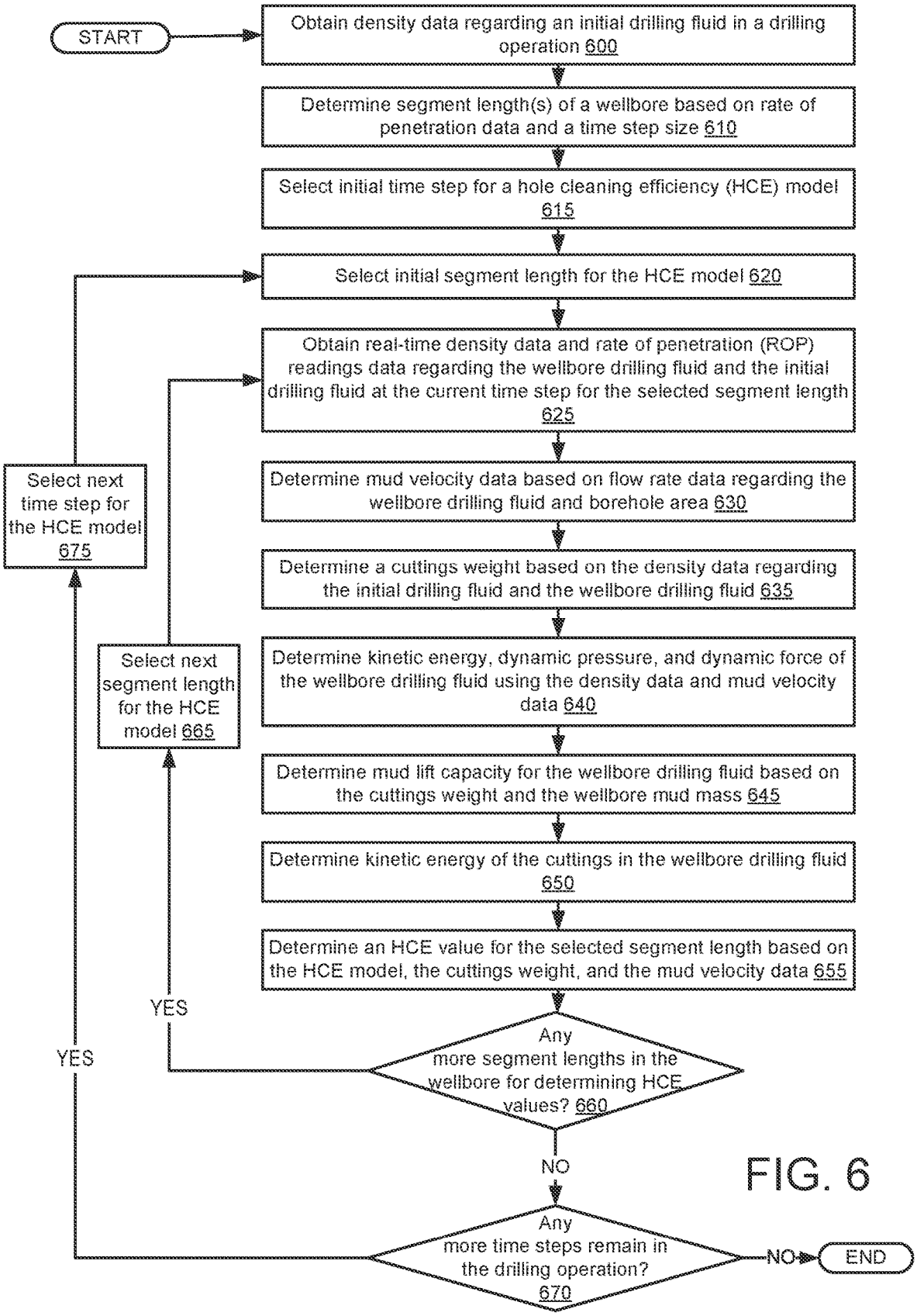
FIG. 6 shows a flowchart in accordance with one or more embodiments.

Turning to FIG. 6, FIG. 6 shows a flowchart in accordance with one or more embodiments. Specifically, FIG. 6 describes a specific method for determining hole cleaning efficiency values for different segment lengths of a wellbore at different time steps. One or more blocks in FIG. 6 may be performed by one or more components (e.g., automated drilling manager (110)) as described in FIGS. 1, 2, and 3. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 600, density data are obtained regarding an initial drilling fluid in a drilling operation in accordance with one or more embodiments.

In Block 610, one or more segment lengths of a wellbore are determined based on rate of penetration (ROP) data and a time step size in accordance with one or more embodiments. In some embodiments, the size of a segment length changes in response to ROP adjustments in a drilling operation. Likewise, changes in density data acquisition at a well site may also result in changes to the size of the segment length.

In Block 615, an initial time step is selected for a hole cleaning efficiency (HCE) model in accordance with one or more embodiments. For example, the initial time step may be selected based on a measurement frequency of a density and rheology unit (DRU), e.g., as part of an automated drilling manager's system. The time step is equal to the period of time between two consequent measurement readings. For example, the initial time step may correspond to a start of a drilling operation. Likewise, the initial time step may be a predetermined time into a drilling operation, e.g., when wellbore drilling fluid is being monitored for lost circulation events.

In Block 620, an initial segment length is selected for a hole cleaning model in accordance with one or more embodiments. For example, the initial segment length may be segment length drilling initially in a wellbore. However, the initial segment length may be a predetermined segment later in a drilling operation as well.

In Block 625, real-time density data and rate of penetration (ROP) readings data are obtained regarding a wellbore drilling fluid and an initial drilling fluid at a current time step for a selected segment length in accordance with one or more embodiments. For example, a real-time density and rheology unit may collect real-time density and rheology data including RPM readings (e.g., 3 rpm, 6 rpm, 300 rpm, 600 rpm) at a well surface before pumping the drilling fluid into the wellbore (e.g., where the collected data may correspond to $\rho_{fresh\text{-}mud}$ and fresh rpm data). For example, density data may be obtained in a similar manner as described above in FIGS. 1 and 4 and the accompanying description.

In Block 630, mud velocity data are determined based on flow rate data regarding a wellbore drilling fluid and a borehole area in accordance with one or more embodiments. For example, mud velocity data may describe one or more mud velocity values. Likewise, mud velocity values may be determined in a similar manager as described above in Block 440 and the accompanying description.

In Block 635, a cuttings weight is determined based on density data regarding an initial drilling fluid and a wellbore drilling fluid in accordance with one or more embodiments. In some embodiments, for example, the cuttings weight is determined in a similar manner as described above in Block 445 and the accompanying description.

In Block 640, a kinetic energy, a dynamic pressure, and a dynamic force of a wellbore drilling fluid are determined using density data and mud velocity data in accordance with one or more embodiments. In particular, a circulating system of drilling fluid may have an internal kinetic energy due to relative motion of drilling fluid in the system. The circulation system may include the wellbore and well equipment downhole and at the well's surface. The kinetic energy per unit volume at each point in an incompressible mud flow is called the dynamic pressure at that point:

$$K.E_{mud} = \frac{1}{2} \times M_{mud} \times \upsilon_{mud}^2 \quad \text{Equation 15}$$

Where $K{\cdot}E_{mud}$ corresponds to the internal kinetic energy for moving drilling fluid in a circulation system, $M_{mud}$ corresponds to a mass of the drilling fluid, and $v_{mud}$ corresponds to a mud velocity of the drilling fluid. At the current segment length, a dynamic pressure and a dynamic force of the drilling fluid in the circulation system may be determined by an automated drilling manager. In some embodiments, the dynamic pressure and the dynamic force are determined using the following equations:

$$K{\cdot}E_{mud}=P_{dynamic,j}\times V_j \quad \text{Equation 16}$$

$$F_{dynamic,j}=P_{dynamic,j}\times A_j \quad \text{Equation 17}$$

where $P_{dynamic,j}$ corresponds to the dynamic pressure of the wellbore drilling fluid (i.e., dynamic pressure or velocity pressure (psi) or the K·E per unit volume of a fluid), $F_{dynamic,j}$ corresponds to the dynamic force of the wellbore drilling fluid, $V_j$ corresponds to a segment volume at a segment j, and $A_j$ corresponds to a borehole area at the segment j.

The dynamic pressure may be derived using the following equations:

$$\frac{K.E_{mud}}{V_j} = \frac{1}{2} \times \frac{M_{mud}}{V_j} \times \upsilon_{mud,j}^2 \quad \text{Equation 18}$$

$$\frac{K.E_{mud}}{V_j} = \frac{1}{2} \times \rho_{dirty-mud,j} \times \upsilon_{mud,j}^2 \quad \text{Equation 19}$$

$$P_{dynamic,j} = \frac{1}{2} \times \rho_{dirty-mud,j} \times \upsilon_{mud,j}^2 \quad \text{Equation 20}$$

Furthermore, in some embodiments, dynamic pressure of a drilling fluid is determined using the following equation:

$$P_{dynamic,j}=P_0-P_s \quad \text{Equation 21}$$

where $P_0$ corresponds to a total pressure (e.g., psi) of a drilling fluid, and $P_s$ corresponds to a static pressure (e.g., psi) of the drilling fluid.

In Block 645, a mud lift capacity is determined for a wellbore drilling fluid is determined based on a cuttings weight and a wellbore mud mass in accordance with one or more embodiments. In particular, mud lift capacity or mud carrying capacity may describe the ability of drilling fluids to lift cuttings from inside the wellbore to the well surface. For example, mud lift capacity may be an essential function of a drilling fluid that affects its hole-cleaning capacity. Mud lift capacity may be affected by an annular velocity, a hole angle, a flow profile, mud weight, cuttings sizes, and pipe position. In some embodiments, a mud lift capacity for a wellbore drilling fluid is determined using the following equation:

$$\text{Mud Lift Capacity } (MLC) = \frac{\text{cuttings weight}}{\text{dirty mud mass}}\% \quad \text{Equation 22}$$

In Block 650, a kinetic energy of cuttings is determined based on a cuttings weight and mud velocity data in accordance with one or more embodiments. In some embodiments, the kinetic energy of cuttings is determined using the following equation:

$$K.E_{cuttings} = \frac{1}{2} \times \text{cuttings weight} \times \upsilon_{mud,j}^2 \quad \text{Equation 23}$$

In some embodiments, mud lift capacity is highly affected by two factors: mud rheology and pump pressure. For example, drilling fluid may have to be high shear-thinning with elevated viscosity, where high shear-thinning during circulation may efficiently push cuttings to the surface with a minimum pump pressure. Thus, the drilling fluid may shear-thicken to increase its viscosity when the circulation stops to gel and thereby hold cuttings from slippage down to the lower part of the wellbore. The pump pressure may correspond to the kinetic energy $K{\cdot}E_{cuttings}$ that causes drilling fluid to move and lift the cuttings. The demand for kinetic energy may increase as the amount of cuttings within the drilling fluid increases. This increment in kinetic energy is directly related to the change in the cuttings accumulation within the mud. Therefore, the kinetic energy required to move contaminated dirty mud with cuttings is higher than the kinetic energy required to move clean mud that has no cuttings. In some embodiments, the steering of kinetic energy may accomplished by changing the pump pressure and the flow rate of the mud. Likewise, part of this energy may be lost as standpipe pressure and bit pressure losses. In some embodiments, $$ECD = \rho_{mud} + \frac{\Delta P_{annular\ friction} + \Delta P_{cuttings} + \Delta P_{surge\&swab} + \Delta P_{rotation} + \Delta P_{acceleration}}{0.052 * TVD} \quad \text{Equation 24}$$

$$\Delta P_{cuttings} = \rho_{mud,average} \cdot g \cdot TVD \quad \text{Equation 25}$$

$$\rho_{mud,average} = \rho_{mud}(1 - c_{cuttings,average}) + \rho_{cuttings} \cdot c_{cuttings,average} \quad \text{Equation 26}$$

$$c_{cuttings,average} = \text{cuttings concentrations } \%$$

$$C_{cuttings} = \frac{C_{cuttings,0}}{R_{transport}} \quad \text{Equation 27}$$

$$R_{transport} = \frac{v_{transport}}{v_{annular}} = 1 - \frac{v_{slip}}{v_{annular}} \quad \text{Equation 28}$$

Where ECD corresponds to an equivalent circulating density, $\rho_{mud}$ corresponds to a drilling fluid density, TVD corresponds to a true vertical depth, $v_{annular}$ corresponds to an annular mud velocity, ΔP corresponds to various pressure changes based on various factors in the wellbore, $\Delta P_{cuttings}$ corresponds to a change in mud pump pressure due to cuttings, g corresponds to an acceleration due to gravity, $R_{transport}$ corresponds to a transport ratio of mud cuttings, and $c_{cuttings,average}$ corresponds to a particular cuttings concentration in a drilling fluid. If the average flow velocity is more than the resulting slip velocity $v_{slip}$, the particles may be carried out of the wellbore, as shown in the following equation:

$$v_{transport}=v_{annular}-v_{slip} \quad \text{Equation 29}$$

Figure 8:
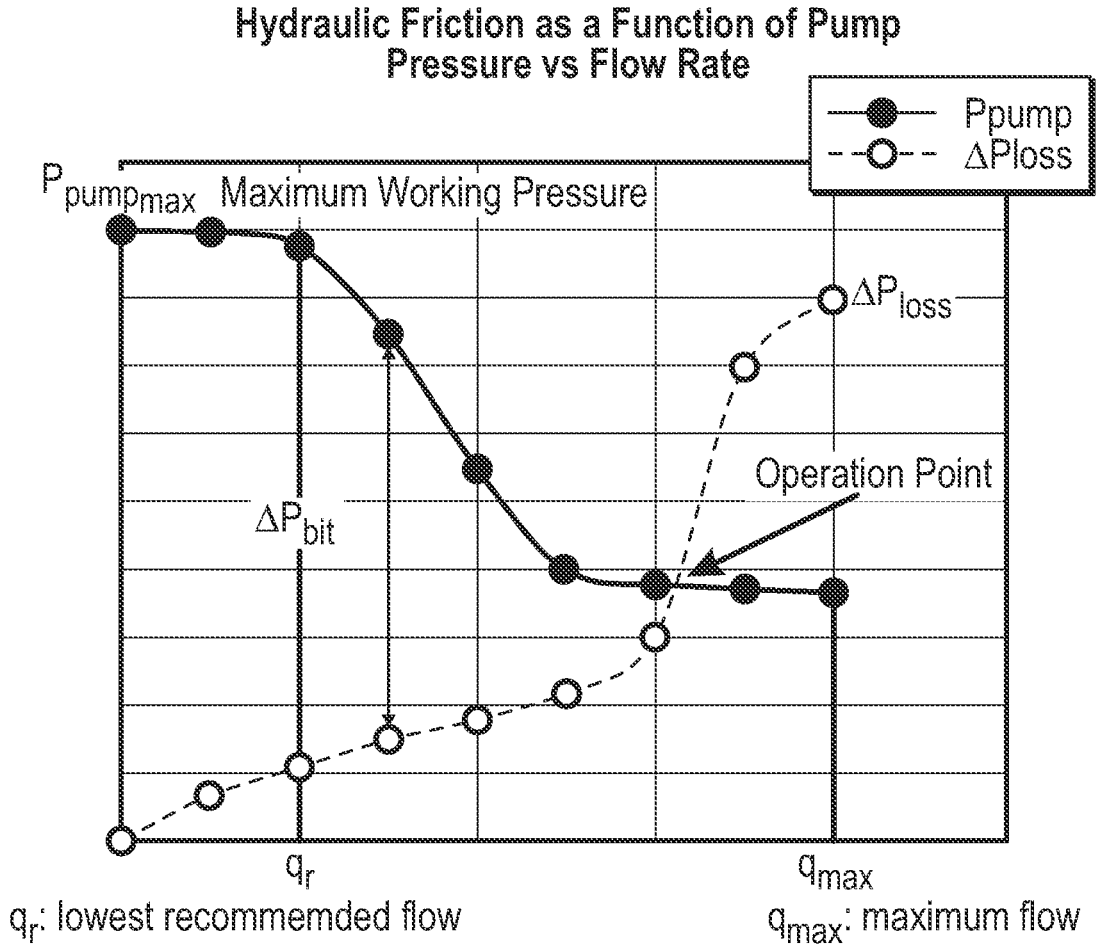
FIG. 8 shows an example in accordance with one or more embodiments.

FIG. 8 is an example figure in accordance with one or more embodiments that shows the relationship between mud pump pressure and drilling fluid flow rates.

Returning to FIG. 6, in Block 655, an HCE value is determined for a selected segment length based on a hole cleaning model, a cuttings weight, and mud velocity data in accordance with one or more embodiments. For example, the HCE value may be obtained using Equation 2 or another hole cleaning model, such as those described above in FIGS. 1 and 4 and the accompanying description.

In Block 660, a determination is made whether any more segment lengths are in a wellbore for determining HCE values in accordance with one or more embodiments. If another segment length is in the wellbore, the process may proceed to Block 665. If HCE values are determined for all segment lengths, the process may proceed to Block 670.

In Block 665, a next segment length is selected for a hole cleaning model in accordance with one or more embodiments.

In Block 670, a determination is made whether any more time steps remain in a drilling operation in accordance with one or more embodiments. If the drilling operation is ongoing, the process may proceed to another time step for collecting real-time density data, mud velocity data, and other rheological data. If the drilling operation has terminated, the process may end. If more time remains for the drilling operation, the process may proceed to Block 675.

In Block 675, a next time step is selected for a hole cleaning model in accordance with one or more embodiments.

Computer System

Figure 7:
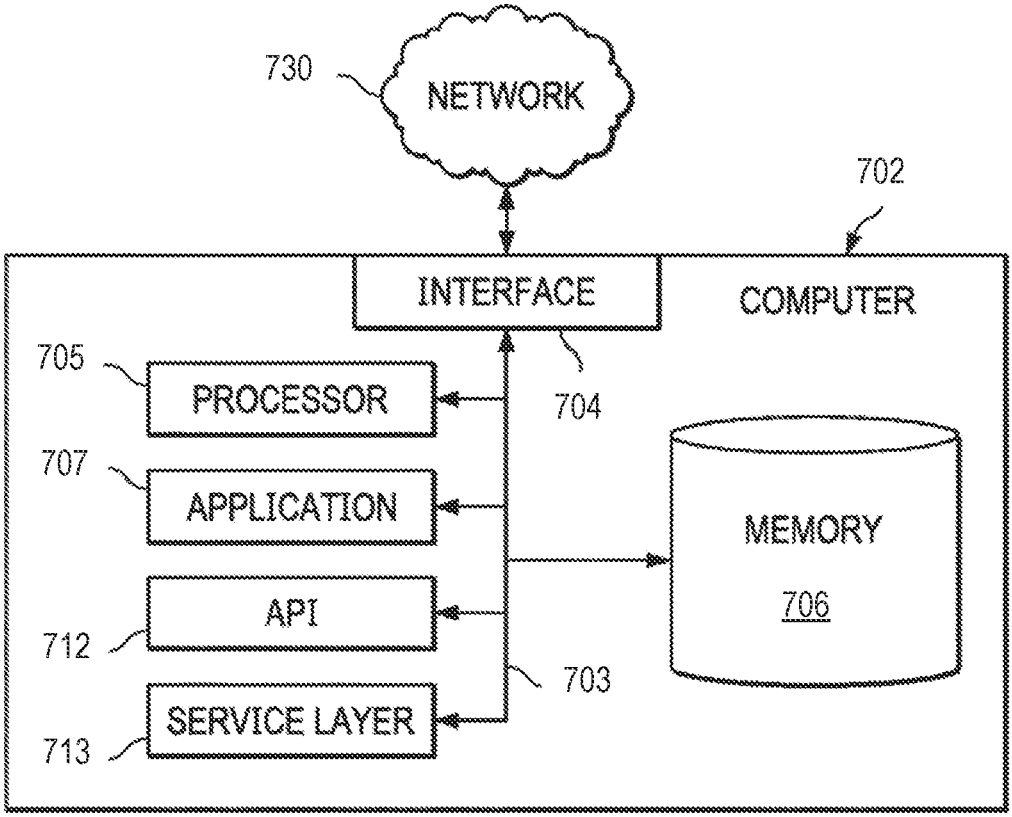
FIG. 7 shows a computer system in accordance with one or more embodiments.

Embodiments may be implemented on a computer system. FIG. 7 is a block diagram of a computer system (702) used to provide computational functionalities associated with described algorithms, methods, functions, processes, flows, and procedures as described in the instant disclosure, according to an implementation. The illustrated computer (702) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730) or cloud. In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) or cloud from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704 includes logic encoded in software or hardware (or a combination of software and hardware) and operable to communicate with the network (730) or cloud. More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

In some embodiments, the computer (702) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), artificial intelligence as a service (AIaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, by a computer processor and in real-time with a drilling operation, first density data regarding a drilling fluid circulating in a wellbore;

determining, by the computer processor, mud velocity data of the drilling fluid in the wellbore based on first flow rate data and a borehole area of the wellbore;

determining, by the computer processor, a cuttings weight of the drilling fluid in the wellbore based on the first density data, wherein the cuttings weight and the mud velocity data correspond to a respective segment length among a first plurality of segment lengths of the wellbore;

determining, by the computer processor and based on the cuttings weight, the mud velocity data, and a hole cleaning model, a first plurality of hole cleaning efficiency (HCE) values for the first plurality of segment lengths of the wellbore;

determining, by the computer processor, whether a first HCE value among the first plurality of HCE values fails to satisfy a predetermined criterion;

determining, by the computer processor and in response to the first HCE value failing to satisfy the predetermined criterion, an adjusted rate of penetration (ROP) value for the drilling operation in the wellbore based on the first HCE value;

determining, by the computer processor and in response to the first HCE value failing to satisfy the predetermined criterion, a predetermined type of lost circulation material (LCM) based on the first HCE value;

transmitting, by the computer processor, a first command to a drilling system that produces the adjusted ROP value in the drilling operation; and transmitting, by the computer processor, a second command to a well system that adjusts the drilling operation to use the predetermined type of LCM.

2. The method of claim 1, further comprising:

determining, by the computer processor, a predetermined density value based on the first HCE value, wherein the predetermined density value increases hole cleaning in the wellbore; and transmitting, by the computer processor and based on the predetermined density value, a command to a mud pump system that adjusts a density of the drilling fluid prior to entering the wellbore.

3. The method of claim 1, wherein the first plurality of segment lengths divide the wellbore based on a rate of penetration (ROP) of a drill string of the drilling operation and a plurality of time steps.

4. The method of claim 1, further comprising:

obtaining, by the computer processor, second flow rate data regarding an initial flow of the drilling fluid in the wellbore;

determining, by the computer processor, an adjusted flow rate of the drilling fluid based on the second flow rate data and a second HCE value failing to satisfy a predetermined criterion, wherein the adjusted flow rate has a greater velocity than a flow rate of the initial flow.

5. The method of claim 1, wherein the cuttings weight is based on a difference between a first mass value and a second mass value that are determined using a respective segment volume corresponding to the respective segment length of the first plurality of segment lengths, wherein the first mass value corresponds to an initial flow of the drilling fluid prior to entering the wellbore, and wherein the second mass value corresponds to a flow of the drilling fluid in the wellbore at the respective segment length.

6. The method of claim 1, further comprising:

determining, by the computer processor, a dynamic pressure of the drilling fluid in the wellbore based on a density value of the drilling fluid and a segment volume of the respective segment length of the first plurality of segment lengths, wherein the dynamic pressure describes a difference between a total pressure of the drilling fluid and a static pressure of the drilling fluid, wherein the density value is obtained from a mud property sensor.

7. The method of claim 6, wherein the drilling fluid is a compressible drilling fluid, and wherein the dynamic pressure is based on a Mach number and a ratio of specific heat.

8. The method of claim 1, further comprising:

obtaining, by the computer processor, flow rate data regarding an initial flow of the drilling fluid in the wellbore;

determining, by the computer processor, an adjusted flow rate of the drilling fluid based on the flow rate data and a second HCE value failing to satisfy a predetermined criterion, wherein the adjusted flow rate is a greater velocity than a flow rate of the initial flow.

9. The method of claim 1, further comprising:

presenting, by a graphical user interface in a user device, a second plurality of HCE values that correspond to a second plurality of segment lengths of the wellbore;

determining whether a second HCE value among the second plurality of HCE values satisfies a predetermined threshold; and obtaining, by the user device, a user selection of an ROP value in response to at least one of the second plurality of HCE values failing to satisfy the predetermined threshold.

10. The method of claim 1, wherein the predetermined criterion is a clean hole threshold.

11. The method of claim 1, further comprising:

determining, by the computer processor, a mud lift capacity for the drilling fluid based on the cuttings weight and a mud mass of the drilling fluid at the respective segment length.

12. A system, comprising:

a drilling system comprising a drill string and a plurality of sensors, wherein the drilling system is coupled to a wellbore;

a mud pump system coupled to the wellbore, wherein the mud pump system is configured to supply a drilling fluid to the wellbore;

an automated mud property system coupled to the mud pump system; and a control system coupled to the drilling system, the automated mud property system, and the mud pump system, wherein the control system comprises a computer processor, the control system comprising functionality for:

obtaining, in real-time with a drilling operation, first density data regarding the drilling fluid circulating in the wellbore;

determining mud velocity data of the drilling fluid in the wellbore based on first flow rate data and a borehole area of the wellbore;

determining a cuttings weight of the drilling fluid in the wellbore based on the first density data, wherein the cuttings weight and the mud velocity data correspond to a respective segment length among a first plurality of segment lengths of the wellbore;

determining, based on the cuttings weight, the mud velocity data, and a hole cleaning model, a plurality of hole cleaning efficiency (HCE) values for the first plurality of segment lengths of the wellbore; and determining whether a first HCE value among the plurality of HCE values fails to satisfy a predetermined criterion;

determining, in response to the first HCE value failing to satisfy the predetermined criterion, an adjusted rate of penetration (ROP) value for the drilling operation in the wellbore based on the first HCE value;

determining, in response to the first HCE value failing to satisfy the predetermined criterion, a predetermined type of lost circulation material (LCM) based on the first HCE value;

transmitting a first command to the drilling system that produces the adjusted ROP value in the drilling operation; and transmitting a second command to the automated mud property system that adjusts the drilling operation to use the predetermined type of LCM.

13. The system of claim 12, further comprising:

a user device coupled to the control system, wherein the user device is configured to provide a graphical user interface for presenting the plurality of HCE values to a user and obtain one or more user selections regarding an adjusted ROP value in response to presenting the plurality of HCE values.

14. The system of claim 12, further comprising:

a first mud property sensor and a second mud property sensor coupled to the control system, wherein the first mud property sensor is configured to acquire second density data regarding an initial drilling fluid, and wherein the second mud property sensor is configured to acquire third density data regarding a wellbore drilling fluid at the respective segment length.

15. The system of claim 12, wherein the control system further comprises functionality for:

determining, in response to the first HCE value failing to satisfy the predetermined criterion, an adjusted rate of penetration (ROP) value for the drilling operation in the wellbore based on the first HCE value; and transmitting a command to the drilling system that produces the adjusted ROP value in the drilling operation.

16. The system of claim 12, wherein the control system further comprises functionality for:

determining, in response to the first HCE value failing to satisfy the predetermined criterion, an adjusted flow rate of the drilling fluid based on the first HCE value, wherein the adjusted flow rate has a greater velocity than a flow rate of an initial flow; and transmitting a command to the mud pump system that implements the adjusted flow rate.

17. A user device, comprising:

a display device;

a processor coupled to the display device; and a memory coupled to the processor, the memory comprising instructions with functionality for:

presenting, using a graphical user interface in the display device, a plurality of hole cleaning efficiency (HCE) values for a drilling fluid in association with a plurality of segment lengths of a wellbore, wherein the plurality of HCE values are based on a hole cleaning model, a cuttings weight of the drilling fluid, and mud velocity data, wherein the cuttings weight of the drilling fluid in the wellbore is based on density data regarding an initial drilling fluid and a wellbore drilling fluid at a respective segment length among the plurality of segment lengths;

obtaining, in response to presenting the plurality of HCE values, a user selection of an adjusted ROP value;

transmitting, in response to the user selection, a first command to a drilling system that produces the adjusted ROP value in a drilling operation;

determining whether a first HCE value among the plurality of HCE values fails to satisfy a predetermined criterion;

determining, in response to the first HCE value failing to satisfy the predetermined criterion, a predetermined type of lost circulation material (LCM) based on the first HCE value; and transmitting a second command to an automated mud property system that adjusts the drilling operation to use the predetermined type of LCM.

18. The user device of claim 17, wherein the graphical user interface provides communication to a control system coupled to the wellbore, wherein the graphical user interface obtains density data and flow rate data regarding the drilling fluid from the control system, and wherein the mud velocity data is based on the flow rate data.

* * * * *